US006263676B1

(12) United States Patent
Keller

(10) Patent No.: US 6,263,676 B1
(45) Date of Patent: Jul. 24, 2001

(54) BURNER HAVING A FRAME FOR OPERATING AN INTERNAL COMBUSTION MACHINE

(75) Inventor: Jakob Keller, deceased, late of Wohlen (CH), by Maria Keller-Schärli, Georg Keller, Vera Keller, legal representatives

(73) Assignee: Asea Brown Boveri AG, Baden (CH)

( * ) Notice: Subject to any disclaimer, the term of this patent is extended or adjusted under 35 U.S.C. 154(b) by 0 days.

(21) Appl. No.: 09/369,838

(22) Filed: Aug. 9, 1999

(30) Foreign Application Priority Data

Aug. 19, 1998 (EP) ..... 98810805

(51) Int. Cl.[7] ..... F23R 3/28
(52) U.S. Cl. ..... 60/737; 60/740; 431/173
(58) Field of Search ..... 60/39.06, 737, 60/740, 746; 431/173

(56) References Cited

U.S. PATENT DOCUMENTS

| | | | | |
|---|---|---|---|---|
| 5,085,575 | * | 2/1992 | Keller et al. | 431/173 |
| 5,169,302 | * | 12/1992 | Keller | 431/173 |
| 5,244,380 | * | 9/1993 | Dobbeling et al. | 431/173 |
| 5,375,995 | * | 12/1994 | Dobbeling et al. | 60/737 |

FOREIGN PATENT DOCUMENTS

| | | |
|---|---|---|
| 4237187A1 | 5/1994 | (DE) . |
| 0321809B1 | 5/1991 | (EP) . |
| 0724114A2 | 7/1996 | (EP) . |
| 1535610 | 8/1968 | (FR) . |

* cited by examiner

*Primary Examiner*—Louis J. Casaregola
(74) *Attorney, Agent, or Firm*—Burns, Doane, Swecker & Mathis, L.L.P.

(57) ABSTRACT

A burner for operating an internal combustion machine, a combustion chamber of a gas turbine group or firing installation is described, having at least two hollow half truncated-cone shaped bodies which are assembled within one another in such way that their longitudinal axes of symmetry extend so that they are mutually radially offset and which enclose at least two tangential air inlet slots for a combustion inlet airflow and also enclose a hollow conical space, and having a nozzle arrangement for injecting liquid, highly reactive fuel into the hollow conical space, which nozzle arrangement is located in the region of the narrowest internal diameter of the hollow conical space. The invention is distinguished by the fact that one injection appliance for fuel is respectively provided, in the direction of the combustion airflow, upstream of each of the tangential air inlet slots, which injection appliance injects the fuel into the air inlet slot with a flow direction parallel to the combustion inlet airflow.

8 Claims, 1 Drawing Sheet

BURNER HAVING A FRAME FOR OPERATING AN INTERNAL COMBUSTION MACHINE

BACKGROUND OF THE INVENTION

1. Field of the Invention

The invention relates to a burner for operating an internal combustion machine, a combustion chamber of a gas turbine group or firing installation, having at least two hollow, half truncated-cone shaped bodies which are assembled within one other in such a way that their longitudinal axes of symmetry extend so that they are mutually radially offset and which enclose at least two tangential air inlet slots for a combustion inlet airflow and also enclose a hollow conical space, and having a nozzle arrangement for injecting liquid, highly reactive fuel into the hollow conical space, which nozzle arrangement is located in the region of the narrowest internal diameter of the hollow conical space. In addition, the invention relates to a method of operating an internal combustion machine, a combustion chamber of a gas turbine group or firing installation.

2. Discussion of Background

A burner of the generic type mentioned above is known, for example, from EP 0 321 809 B1 and is employed with great success for firing gas turbine installations. This type of burner is considered as a successful initial type for burners which have been designed for firing with highly reactive, gaseous and liquid fuels with a high calorific value of approximately 35 to 50 MJ/kg. In these, the liquid fuel is introduced in the form of a conically forming fuel spray to within the combustion chamber by means of a nozzle arrangement centrally fitted to the hollow conical space. The conical fuel spray is enclosed by a rotating combustion airflow flowing tangentially into the hollow conical space and is stabilized by it. It is only in the vortex collapse region, i.e. in the region of the so-called reverse flow zone, that the optimum, homogeneous fuel concentration is achieved over the cross section, so that the ignition of the fuel mixture takes place in this region. Gaseous fuel is injected from two tubes, which are arranged along the air inlet slots of the burner, through rows of holes transverse to the entering airflow.

The internal and external shape of the burner specified by the double-cone structure can be regarded as the end product of a comprehensive optimization process in which the burner has been optimized from the viewpoint of burning liquid fuel of high calorific value.

Building on the basis of the successful burner form concept which is described in EP 0 321 809 B1, it is appropriate to seek solutions promising success in permitting the additional combustion of low and medium calorific value fuels.

SUMMARY OF THE INVENTION

Accordingly, one object of the invention is to provide a novel further development of a burner whose spatial configuration is specifically optimized for the combustion of gaseous and liquid fuel of high calorific value, in such a way that the combustion of medium and/or low calorific value fuels is possible without impairing the shape and configuration of the burner and without deterioration of the emission figures. The measures to be taken for this purpose should, as far as possible, be suitable for the retrofitting of existing burners and have a simple configuration. Modifications necessary on the burner itself should be kept as small as possible so that, using a single type of burner, low, medium and high calorific value fuels can be burned. Finally, a method for operating a burner is to be provided such that the combustion of low, medium and high calorific value fuels with constant or reduced emission figures is possible. In addition, it should be possible to burn fuels of high hydrogen content without difficulty.

In accordance with the invention, an injection appliance is arranged upstream of each of the air inlet slots in such a way that the fuel to be introduced into the combustion airflow is injected into the air inlet slots parallel to the flow direction of the combustion inlet airflow. The parallel fuel feed avoids any turbulence within the combustion inlet airflow so that no irritating vortex formation, which leads to local fuel concentrations and causes uncontrolled ignition events, occurs.

The jet arrangement is, in particular, configured in such a way that the outlet velocity of the fuel from the jet arrangement has approximately the same flow velocity as that of the combustion inlet airflow introduced into the air inlet slots. Due to the isokinetic mass flow inlet behavior, any dynamic pressure differences are also avoided, by which means disturbing vortex formations can likewise be excluded.

In the case of the burner system described, which has two air inlet slots, the nozzle arrangement in accordance with the invention has two injection appliances which are respectively positioned upstream of the air inlet slots. The two injection appliances are permanently connected together by means of a framework and can be firmly and removably fitted to the burner by means of corresponding connecting elements. Each of the respectively provided inlet appliances extends lengthwise over the complete length of the air inlet slots and each has within it a preferably straight fuel supply line which is connected to the nozzle outlet region via a restricted supply duct.

The restricted supply duct can be configured either as a plurality of individual holes which have a distributed arrangement along the fuel supply duct or as a continuous supply slot which extends over the complete length of the injection appliance. The nozzle outlet region is preferably configured as a continuous slot duct which extends over the complete length of the injection appliance and has a duct length/width ratio which leads to a directed fuel jet, extending almost parallel and having in addition, as already mentioned above, a flow velocity matched to the flow velocity of the combustion inlet air.

BRIEF DESCRIPTION OF THE DRAWINGS

A more complete appreciation of the invention, which is described below without limitation of the general invention concept by using an embodiment example, and many of the attendant advantages of the invention will be readily obtained as the same becomes better understood by reference to the following detailed description when considered in connection with the accompanying drawings wherein.

DESCRIPTION OF THE PREFERRED EMBODIMENTS

Figure 1:
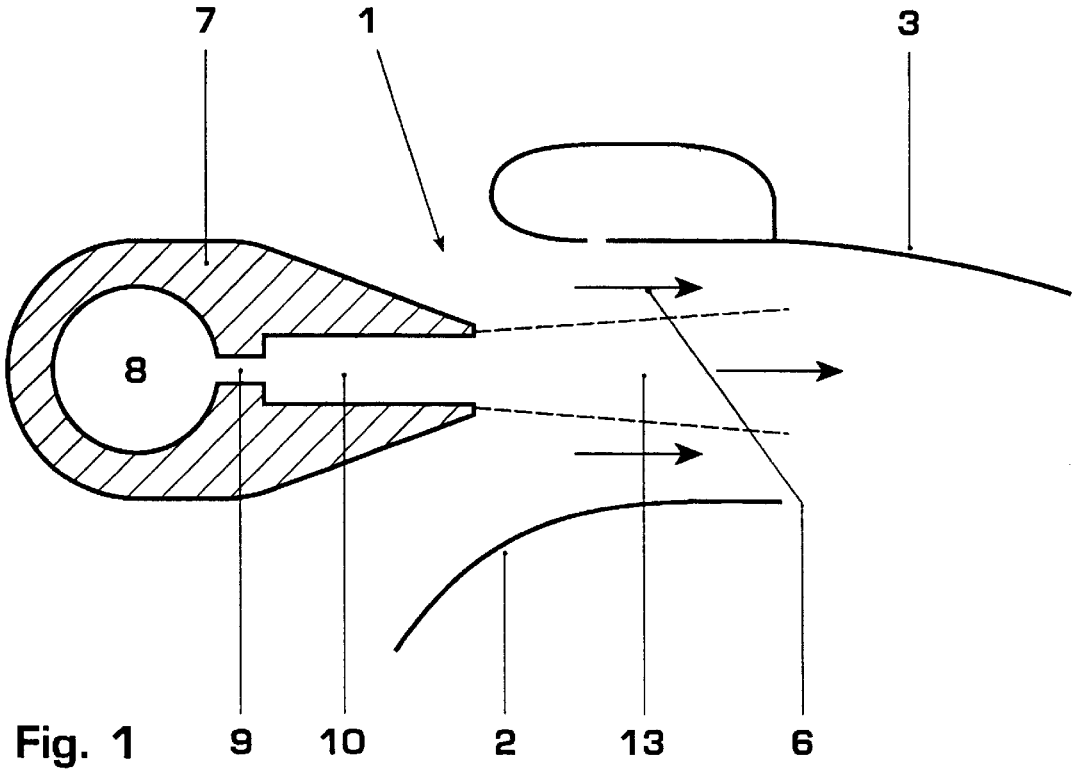
FIG. 1 shows a diagrammatic cross section through an injection appliance which is arranged upstream of an air inlet slot.

Referring now to the drawings, wherein like reference numerals designate identical or corresponding parts throughout the views, FIG. 1 shows a diagrammatic cross-sectional representation through the air inlet slot 1 of a burner (not represented in any more detail). The air inlet slot 1 is bounded, on the one hand, by the external wall of a first truncated-cone shaped body 2 and by the internal wall of a second truncated-cone shaped body 3. In the flow direction of the fuel inlet flow 6, an injection appliance 7 is provided upstream of the air inlet slot 1 which provides a fuel supply line 8 parallel to its longitudinal axis, which fuel supply line 8 is connected via a restricted supply duct 9 to the nozzle outlet region 10 of the injection appliance 7. The restricted supply duct 9 can be configured either as a plurality of individual holes located adjacent to one another or as a continuous slot opening which extends over the complete length of the injection appliance 7. The restricted supply duct 9 has, on the one hand, the task of decoupling possibly occurring acoustic oscillations within the fuel supply line 8 from the nozzle outlet region 10. On the other hand, the restricted supply duct 9 causes a throttling of the working pressure present within the fuel supply line 8 in the direction of the nozzle outlet region. The nozzle outlet region has a length and width matched to the pressure and flow relationships of the fuel, by which means a fuel flow field 13 is specifically generated which can be substantially introduced to the fuel supply flow 6 in the air inlet slot 1 as a two-dimensional flow field with the same velocity.

Figure 2:
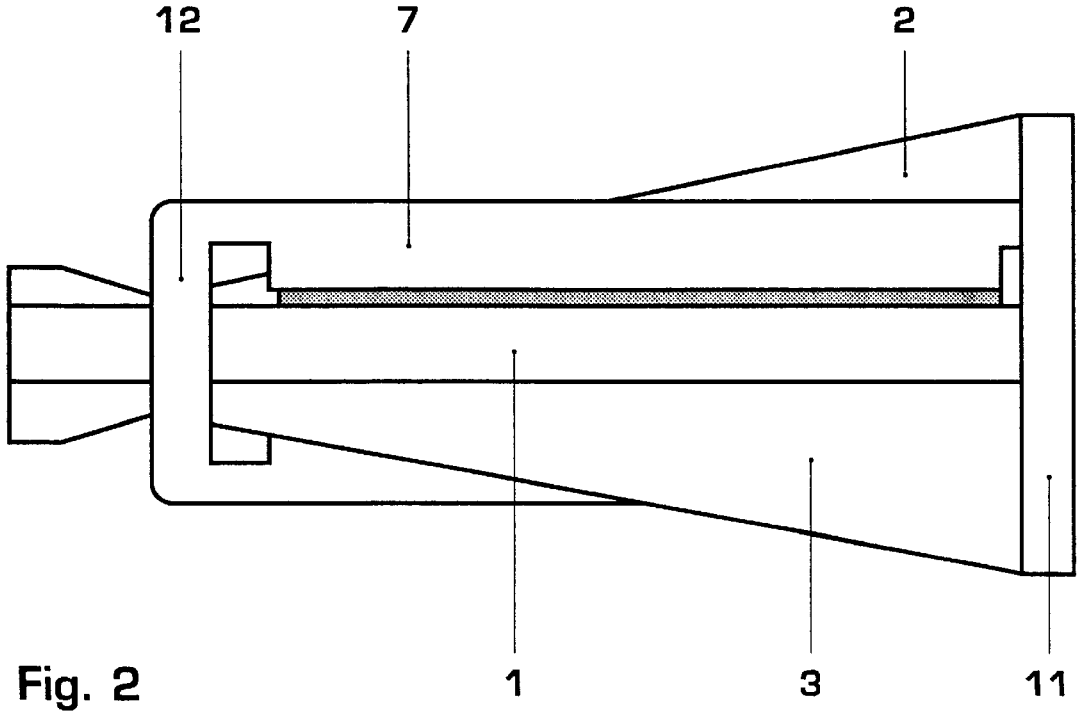
FIG. 2 shows a diagrammatic side representation of a burner with the injection appliance according to the invention.

FIG. 2 shows a side representation of the extended burner according to the invention. This burner is composed of the first truncated-cone shaped body 2 and the second truncated-cone shaped body 3. The two truncated-cone shaped bodies enclose two air inlet slots, of which the air inlet slot 1 is shown in FIG. 2. An injection appliance 7, which is firmly and removably connected (at least at one end) to a baseplate 11 of the burner, is provided upstream of the air inlet slot 1. The injection nozzle appliance 7 is connected to the injection appliance opposite to it on the burner (at the rear in FIG. 2) by means of a frame 12 of preferably annular configuration.

The injection appliance according to the invention can be guided for assembly over existing burner systems and can be firmly connected to the burner in a suitable manner. In this way, the injection appliance should be regarded as an additional module which can be retrofitted as required.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A burner useful for operating a gas turbine group comprising:

at least two hollow, half truncated-cone shaped bodies, each body having a longitudinal axis of symmetry, the bodies being assembled within one another in such a way that their longitudinal axes of symmetry extend so that they are mutually radially offset and which enclose at least two tangential air inlet slots for a combustion inlet airflow and also enclose a hollow conical space; and a nozzle arrangement for injecting liquid, highly reactive fuel into the hollow conical space, the nozzle arrangement located in the region of the narrowest internal diameter of the hollow conical space, the nozzle arrangement including at least one injection appliance for fuel per air inlet slot in the direction of the combustion inlet airflow, the injection appliances positioned upstream of each of the tangential air inlet slots, the injection appliances oriented and configured for injecting the fuel into the air inlet slots with a flow direction parallel to the combustion inlet airflow;

a single frame integral with the injection appliances, the injection appliances being connected together by the single frame and configured as a uniform module which can be removably fastened to the burner.

2. The burner as claimed in claim 1, wherein the injection appliances are for injecting the fuel isokinetically relative to the combustion inlet air.

3. The burner as claimed in claim 1, wherein the uniform module is configured and arranged to be placed and fastened on the burner.

4. The burner as claimed in claim 1, wherein each injection appliance has a linearly extending fuel supply line, a supply duct, and a nozzle outlet region connected to the fuel supply line by the supply duct the supply duct being restricted relative to the nozzle outlet region.

5. The burner as claimed in claim 4, wherein each nozzle outlet region is a slot nozzle which extends along the complete length of the air inlet slot.

6. The burner as claimed in claim 1, wherein each injection appliance has a plurality of individual jet nozzles which generate a substantially homogeneous fuel jet over the length of the air inlet slot when fuel is supplied through the injection appliances.

7. The burner as claimed in claim 1, further comprising a fuel flowing through each injection appliance, the fuel being selected from the group consisting of medium calorific value fuel and low calorific value fuel.

8. The burner as claimed in claim 7, wherein the fuel has calorific values between 5 and 50 MJ/kg.

* * * * *